US005412872A

United States Patent [19]

Iderosa

[11] Patent Number: 5,412,872

[45] Date of Patent: May 9, 1995

[54] RAZOR HEAD WITH EXPANDABLE SPACER

[75] Inventor: Richard Iderosa, West Haven, Conn.

[73] Assignee: Warner-Lambert Company, Morris Plains, N.J.

[21] Appl. No.: 101,884

[22] Filed: Aug. 4, 1993

[51] Int. Cl.[6] ..... B26B 21/40

[52] U.S. Cl. ..... 30/50; 30/90

[58] Field of Search ..... 30/50, 52, 71, 72, 73, 30/79, 90

[56] References Cited

U.S. PATENT DOCUMENTS

| | | | |
|---|---|---|---|
| 2,794,252 | 6/1957 | Plesch | 30/50 X |
| 4,205,437 | 6/1980 | Chen et al. | 30/41 |
| 4,344,227 | 8/1982 | Chen et al. | 30/41 |
| 5,276,967 | 1/1994 | Ferraro et al. | 30/49 |

*Primary Examiner*—Richard K. Seidel
*Assistant Examiner*—Raymond D. Woods
*Attorney, Agent, or Firm*—Charles W. Almer, III

[57] ABSTRACT

A razor head is advantageously formed with a spacer that is capable of expanding after manufacturing assembly to provide a tighter blade package.

8 Claims, 2 Drawing Sheets

RAZOR HEAD WITH EXPANDABLE SPACER

The present invention is directed to an improved razor head and, more particularly, to a razor head having a spacer which is designed to expand after manufacturing.

BACKGROUND OF THE INVENTION

Many razor heads are formed of separate pieces, including a seat with a guard bar, one or two blades separated by a spacer, and a cap. These elements are often formed separately and are then assembled during manufacturing. While some shaving systems are engineered to permit relative movement of these elements during shaving, it is desirable to control the direction and range of movement in the manufactured product.

In a typical two-blade rigid shaving system, a blade package having two blades separated by a spacer is sandwiched between the cap and the seat. The package is typically held together by pins which depend downwardly from the cap, pass through holes in the blades, and spacer, and are snap fit or mechanically staked into complementary receptive holes in the seat. Such systems are ideally designed to prevent relative movement of the blades with respect to the guard bar and cap. Tolerances built into such systems to accommodate manufacturing limitations result in these elements being formed with imperfections lying within tolerable ranges. Though these tolerances can be relatively small, such as a few ten thousandths of an inch, they can nonetheless result in undesirable movement between the blades and the other elements of the razor head. Particularly, cutting forces encountered during shaving are known to cause deflections of a seat blade causing the sharpened edge of the seat blade to move upwardly and away from the guard bar during shaving. Such deflections cause inconsistent blade geometries and can result in an uncomfortable shave and may produce less than optimum shave results.

The disadvantages which accompany undesired blade deflections are not limited to rigid shaving systems. For example, the Schick® Division of the Warner Lambert Company has developed a flexible system designed to follow the contours of a curved surface, which is marketed under the name TRACER TM. While the entire blade package is designed to flex, and the blades are permitted to move laterally relative to the seat when the razor head is flexed, lateral relative movement between the blades and the guard bar are still undesirable.

It would, therefore, be desirable to provide a razor head wherein manufacturing imperfections resulting in blade deflections during shaving would be reduced and/or eliminated. Blade deflections could be reduced by providing a razor head wherein the spaces left between adjoining elements due to manufacturing tolerances and imperfections would be substantially eliminated.

SUMMARY OF THE INVENTION

The various embodiments of the present invention provide razor heads utilizing novel spacers having properties which cause the spacer(s) to expand under conditions typically encountered during shaving and to therefore reduce and/or eliminate undesired gaps between the razor head elements existing at the time of manufacture.

According to one embodiment of the present invention, at least one spacer is provided between a two-blade shaving system wherein the spacer is formed of a substantially hygroscopic material. The spacer absorbs moisture after manufacturing assembly and swells. Upon swelling, the spacer fills voids left by imperfections, inconsistencies, and design tolerances of the manufacturing process.

According to another embodiment of the present invention, a "spacer" is positioned either above, below, or both above and below a blade in a single blade shaving system. In this sense, the "spacer" of the present invention is not limited to an element of a shaving system which is positioned between two blades. As used herein, the term "spacer" is meant to include an element which expands after manufacturing assembly.

According to an alternative embodiment, the expansion of the spacer is thermally activated.

The present invention also comprises novel methods for forming razor head assemblies which incorporate spacers that will expand after manufacturing assembly. According to one method of the present invention, a spacer is subjected to compressive physical forces in order to decrease the size of the spacer during assembly. The razor head is then assembled. In any areas where gaps remain between the assembled elements, the spacer will have a tendency to expand in an effort to resume its original size.

According to another method of the present invention, the spacer is stored under conditions which will cause it to be smaller than when it encounters the conditions typically encountered during shaving. For example, in one embodiment, the spacer is maintained in a relatively dry atmosphere. According to this embodiment, when the spacer encounters a higher relative humidity either during or before shaving, in any event after assembly, the spacer will have a tendency to expand thereby filling spaces left during manufacturing. The higher relative humidity may, for example, be encountered during shipping, storing and/or shaving.

According to an alternative embodiment, the spacers are maintained at a reduced temperature. According to this embodiment, when the spacers encounter higher temperatures during shaving, but in any event after assembly, the spacer will tend to expand.

The present invention is useful with both rigid and flexible razor heads.

DETAILED DESCRIPTION

The various embodiments of the present invention are designed to provide razor heads having a blade package, comprising one or more blades, which are maintained more securely against blade deflections than razor heads known in the art. As used herein, the term "razor head" is meant to include disposable cartridges designed for separate attachment to a razor, as well as the operative portion of a razor wherein the operative cutting portion is integrally formed with the handle portion. According to the present invention, razor heads and methods of forming razor heads are disclosed which utilize novel spacers designed to exert forces on the blade package after manufacturing assembly. The forces exerted are designed to hold the blade package more securely against undesired relative movement, such as pivoting and deflecting, relative to the other elements of the blade package in response to forces encountered during shaving.

Figure 1:
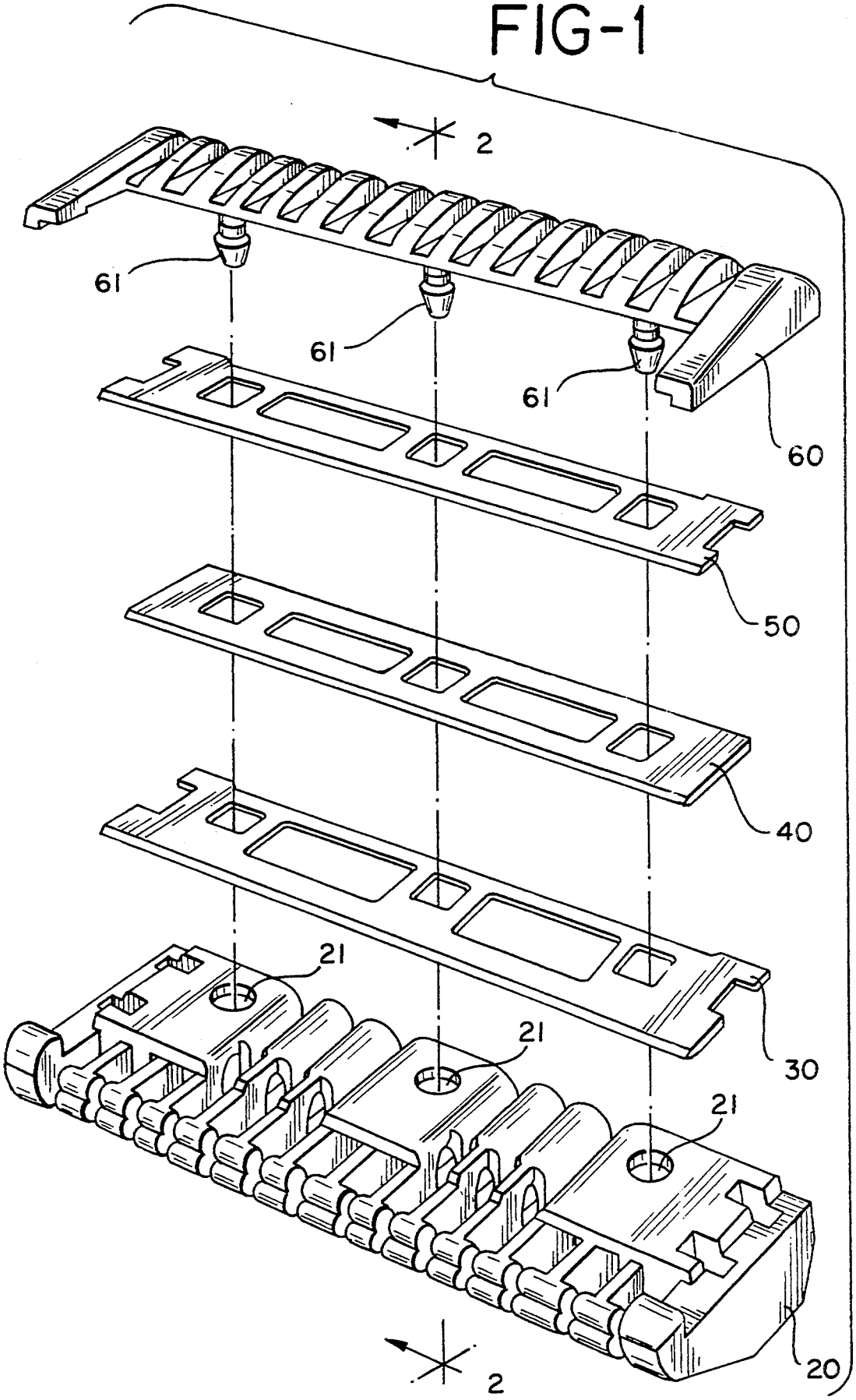
FIG. 1 is an exploded, perspective view of one embodiment of the present invention.
Figure 2:
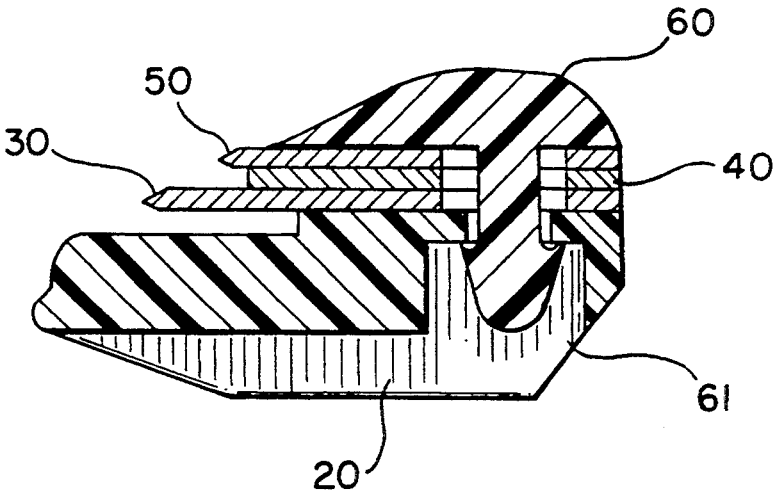
FIG. 2 is a cross sectional view taken along lines 2—2 of FIG. 1.

One preferred embodiment of the present invention is illustrated in FIG. 1. This embodiment comprises a flexible razor head having a seat 20, a seat blade 30, a spacer 40, a cap blade 50 and a cap 60. The elements of this razor head are held together by pins 61 which depend downwardly from cap 60 and are snapped fit or mechanically staked into receptive holes 21 in seat 20. As shown in the cross sectional view of FIG. 2, each pin 61 is formed with a length sufficient to properly engage holes 21 in seat 20 and to allow the bulbous end portion of pin 61 to engage the bottom of holes 21. The razor head of this embodiment is simply formed by manufacturing the separate elements and then aligning pins 61 with the respective holes in the other elements in the manner illustrated in FIG. 1 prior to pressing pins 61 into holes 21. Those skilled in the art will appreciate that such razor heads may be more easily formed in an upside down manner such that the cap blade, spacer 40 and seat blade 40 are consecutively placed onto pins 61 before seat 20 is snapped onto stake 61 in order to lock the other elements in place.

As stated above, spacer 40 is formed of a material which is designed to expand after the assembly step of the manufacturing process. According to one embodiment of the present invention, spacer 40 is formed of a hygroscopic material which absorbs water and therefore expands after manufacturing assembly to fill voids between the spacer and adjacent elements and to exert pressure on the blades. In effect, when configured in the conventional manner shown in FIG. 1, spacer 40 will, upon absorbing moisture, exert forces on cap blade 50 pushing the cap blade 50 upwardly against cap 60. Similarly, the tendency of spacer 40 to expand will exert downward pressure on seat blade 30 in order to hold seat blade 30 more tightly against seat 20.

This illustrated embodiment is not intended to limit the application the present invention. For example, a plurality of spacers can advantageously be provided in other locations, such as between the cap 60 and cap blade 50, as well as between the seat 20 and seat blade 30 in order to fill undesired voids between those elements of the razor head.

The hygroscopic spacers of the present invention may be formed of any material having a significant tendency to absorb moisture. For example, bass wood is one material useful in forming spacers of the present invention. From the present description, those skilled in the art will appreciate that the spacers may be formed of any natural and/or synthetic material or blend capable of satisfactorily performing under conditions typically encountered during shaving. For example, a material having a tendency to expand upon moisture absorption which fell apart would not be suitable. Furthermore, spacer formed of one material serving as a matrix which exudes a second material in the presence of moisture would also not be suitable for the present invention if the material exuded would singularly be washed away during shaving.

Other suitable hygroscopic material comprise other cellulose materials such as cellulose acetate which exhibits sufficient structural integrity and expansion capabilities.

Under the conditions typically encountered during wet shaving, particularly the relative humidity and temperatures, for example, a relative humidity of at least 90% and a temperature of at least 38° C. (100° F.), the spacers preferably have a modulus of elasticity of at least 100 ksi.

For an application such as the illustrated embodiment shown in FIG. 1, a spacer would typically have a length of 1½ inches, a width of about ½ inch and a thickness of about 0.02 inches. Since voids occurring during manufacturing might be as much as 0.0005 inches, which represents about 2.5% of the thickness of the spacer, the spacer material preferably provides a minimum thickness increase of 2.5% when the spacer alone encounters a change on the relative humidity scale of about 50%. For example, if the spacer is moved from an environment with a 40% RH to an environment with a 90% RH a thickness change of 2.5% would occur absent outside forces. The spacer material is more preferably capable of expanding to a thickness which is at least 5% greater and most preferably at least 10% greater when encountering such a change in relative humidity.

Figure 3:
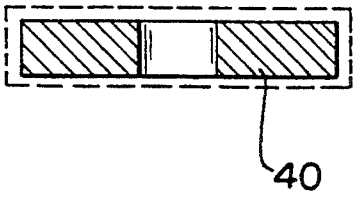
FIG. 3 is a cross sectional view of the spacer shown in FIG. 1 along lines 2—2 illustrating an increased volume in phantom.

The phantom outline in FIG. 3 generally indicates the expandable nature of a spacer. It will also be appreciated by those skilled in the art that when using hygroscopic spacers of the illustrated embodiment, it is most preferable to conduct the manufacturing assembly step at a relative humidity which is as low as practical. In this manner, the high humidities typically encountered during wet shaving will cause maximum swelling and maximum effectiveness of the spacers of the present invention. Since swelling and shrinking caused by changes in relative humidity will typically take some time, the spacers are also preferably stored under controlled conditions until a short period of time prior to manufacturing assembly. As used herein, the term "manufacturing assembly" includes the step in which a number of elements such as those illustrated in FIG. 1 are connected, as well as a molding step in instances where the razor head is formed of integrally molded elements. In the case of an integrally molded razor head, it is contemplated that the blade(s) and the spacer(s) are first disposed in a mold cavity prior to the injection of the molded material.

The present invention also comprises methods of forming razor heads wherein the razor head is assembled using spacers meeting the criteria set forth above under conditions significantly different from those typically encountered during shaving. For example, manufacturing assembly would occur at a low relative humidity, for example not more than 40% RH, preferably not more than 20% RH, and/or at spacer temperatures not exceeding 50° F., most preferably not exceeding 35° F. Razor heads manufacturing according to these methods will have spacers which expand when exposed to conditions typically encountered during shaving.

Though the illustrated embodiment of the present invention comprises a spacer disposed between two blades in a conventional fashion, it is well within the scope of the present invention to dispose a spacer in a different location within a blade package. For example, in a single blade system, a spacer can simply be disposed above or below the single blade. Alternatively more than one spacer formed of a material having the desired properties could be utilized. For example, two spacers could be utilized with one above the blade and one below the blade in order to increase the beneficial effects of the spacer expansion.

The novel spacers of the present invention therefore have a structure which increases in volume, particularly in thickness, when exposed to the conditions typically encountered during wet shaving. The spacers of the present invention can be distinguished from other elements previously used in wet razors which would leach a shaving aid from a matrix and wherein the shaving aid would essentially be rinsed or abraded away during shaving.

The effectiveness of one embodiment of the present invention utilizing a cellulose acetate spacer is illustrated by the following example.

EXAMPLE 1

In order to test the effectiveness of a hygroscope cellulose acetate spacer on minimizing blade deflection, five cartridges were formed having a single cellulose acetate spacer positioned between the blades. The spacer was formed in a conventional manner having a thickness of 0.02 inches upon manufacturing. The blade deflection was tested at ambient conditions and then again after exposing the cartridges to high humidity conditions (18 hours in water). As used herein, "blade deflection" is the amount of movement on the blade 0.040 inches from the cutting edge in response to a force directed on that point while the rest of the razor head is held fixed. Blade deflection measurements were taken at three different positions, recorded and then averaged. The following table provides the blade deflections at the initial, i.e. ambient, conditions and after exposure to water.

| Cartridge | Ambient | 18 hr. $H_2O$ Exposure | % increase in STIFFNESS |
|---|---|---|---|
| 1 | 1.10 | .98 | 12.2 |
| 2 | .78 | .78 | 0 |
| 3 | 1.18 | .88 | 34 |
| 4 | .84 | .76 | 10.5 |

-continued

| Cartridge | Ambient | 18 hr. $H_2O$ Exposure | % increase in STIFFNESS |
|---|---|---|---|
| 5 | 1.10 | .92 | 19.5 |

Blade deflections are expressed in thousandths of an inch in response to a weight of 0.088 pounds.

The results of the table indicate that the spacer of the present invention advantageously reduces the undesirable blade deflection. The greatest increases in blade stiffness were obtained with the razor heads exhibiting the largest deflections under ambient conditions. The results indicate that under these test conditions, blade deflections could be reduced toward the range of 0.75–0.80 utilizing the present invention.

I claim:

1. A razor head particularly adapted for wet shaving comprising:

a blade seat;

a cap;

at least one blade located between said blade seat and said cap; and a spacer located adjacent said at least one blade;

wherein said spacer is formed of a material which expands from a first thickness to a second thickness which is at least 2.5% larger than said first thickness during wet shaving.

2. A razor head according to claim 1 wherein said spacer comprises a hygroscopic material.

3. A razor head according to claim 2 wherein said spacer comprises cellulose.

4. A razor head according to claim 2 wherein said spacer comprises wood.

5. A razor head according to claim 2 wherein said spacer comprises cellulose acetate.

6. A razor head according to claim 2 where said spacer comprises bass wood.

7. A razor head according to claim 1 wherein said cap and said blade seat are integrally formed.

8. A razor head according to claim 1 wherein said cap and said blade seat are connected by pins which pass through said blade.

* * * * *